US007347022B2

(12) United States Patent
Gussalli Beretta

(10) Patent No.: US 7,347,022 B2
(45) Date of Patent: Mar. 25, 2008

(54) GUN AND METHOD FOR ASSEMBLING A GUN

(75) Inventor: Ugo Gussalli Beretta, Brescia (IT)

(73) Assignee: Fabbrica d'Armi Pietro Beretta, Brescia (IT)

( * ) Notice: Subject to any disclaimer, the term of this patent is extended or adjusted under 35 U.S.C. 154(b) by 69 days.

(21) Appl. No.: 11/260,378

(22) Filed: Oct. 28, 2005

(65) Prior Publication Data

US 2006/0207151 A1 Sep. 21, 2006

(30) Foreign Application Priority Data

Nov. 11, 2004 (IT) ..... MI2004A2167

(51) Int. Cl.
*F41A 19/15* (2006.01)

(52) U.S. Cl. ..... 42/69.01; 89/196

(58) Field of Classification Search ..... 42/106, 42/71.01–73, 69.01–69.03
See application file for complete search history.

(56) References Cited

U.S. PATENT DOCUMENTS 2,659,994 A * 11/1953 Yale ..... 42/69.02
3,024,559 A 3/1962 Weatherby
3,713,241 A * 1/1973 Dieckmann ..... 42/69.03
3,830,003 A * 8/1974 Clerke ..... 42/75.03
3,863,375 A * 2/1975 Browning ..... 42/69.01
4,409,882 A * 10/1983 Blackshaw et al. ..... 89/163
4,536,981 A * 8/1985 Giragosian ..... 42/69.03
4,679,487 A 7/1987 Houseman
4,891,898 A * 1/1990 Houseman ..... 42/69.02
5,454,182 A * 10/1995 Lewis et al. ..... 42/51
5,487,233 A * 1/1996 Jewell ..... 42/69.01
6,487,806 B2 * 12/2002 Murello et al. ..... 42/75.03
6,722,072 B1 * 4/2004 McCormick ..... 42/75.03
7,162,824 B1 * 1/2007 McCormick ..... 42/75.03

FOREIGN PATENT DOCUMENTS

FR 786.652 9/1935

OTHER PUBLICATIONS

European Search Report, Feb. 2, 2006 for European Patent Application No. EP 05 42 5709.

* cited by examiner

*Primary Examiner*—Bret Hayes
(74) *Attorney, Agent, or Firm*—Hogan & Hartson LLP

(57) ABSTRACT

A gun comprises a frame and a framework on which at least some components of a firing mechanism are mounted. The framework is inserted into a cross cavity of the frame and means for locking the framework within the frame are provided. The framework holds the whole firing mechanism except for a trigger and a connecting lever extending from the trigger. The framework comprises two hangers adapted to be laterally inserted into the cross cavity. The hangers are arranged at a mutual distance and the components of the firing mechanism are assembled between the two hangers being connected to each other by means of a bridge.

46 Claims, 5 Drawing Sheets

GUN AND METHOD FOR ASSEMBLING A GUN

FIELD OF THE INVENTION

The objects of the present invention are a gun and a method for assembling a gun.

BACKGROUND OF THE INVENTION

The known guns comprise a so-called frame adapted to house the firing mechanism, i.e. the chain of elements which kinematically connect the trigger to the hammer, optionally comprising either inserting or disconnecting levers of automatic and/or manual safety devices. Most of the elements constituting the firing mechanism are rotary mounted around a pin being transversally inserted into the frame.

Therefore, it is known that the assembling step of a gun is made complicated and long by the need to mount each single element of the firing mechanism on its own pin or in any case inside its own housing within the frame. The same drawback is found even in the case of weapon complete overhauls, usually performed by skilled operators, which involve the assembly and reassembly of the firing mechanism.

The problem at the heart of the present invention is to provide a gun having such structural and functional characteristics as to overcome said drawbacks mentioned above with reference to the prior art.

SUMMARY OF THE INVENTION

This problem is solved by means of a gun in accordance with claim 1.

The dependent claims relate to further embodiments of the present invention.

BRIEF DESCRIPTION OF THE DRAWINGS

Further characteristics and the advantages of the gun according to the invention will be understood by the description of preferred exemplary embodiments as set forth herein below, which are given by way of indicative and non-limiting examples, with reference to the annexed figures, in which.

DETAILED DESCRIPTION OF THE INVENTION

Figure 1:
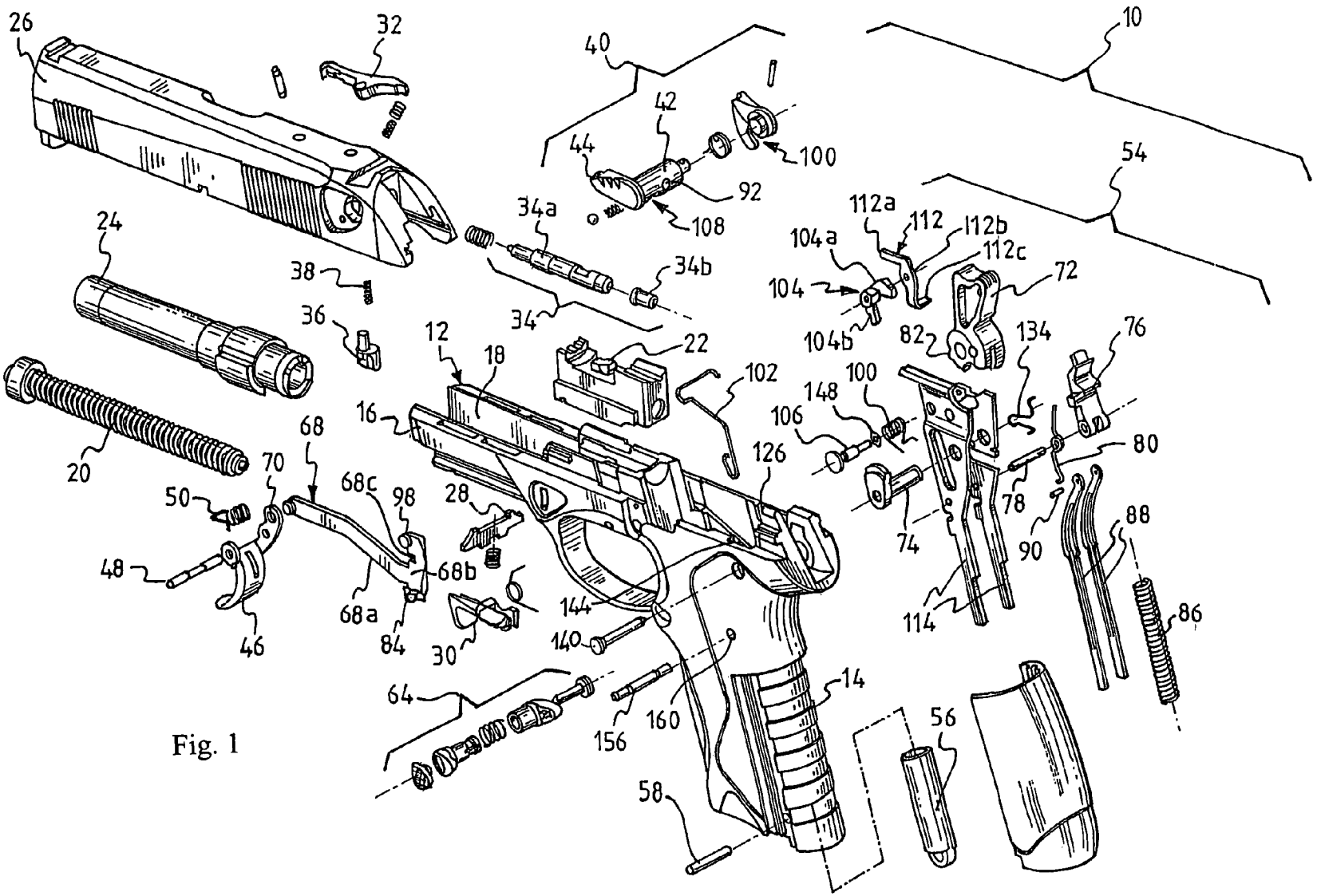
FIG. 1 shows an exploded view of some components of a gun according to the present invention.

With reference to said figures, a gun comprising a frame 12 has been indicated as a whole with 10.

The reference terms used in the following refer to the gripped gun. Particularly, with "front" has been indicated a portion from the muzzle side and with "rear" a portion which is opposite to the muzzle. Moreover, the terms "upper" and "lower" have been used with reference to the gripped weapon and a vertical direction.

In accordance with a possible embodiment, the frame 12 comprises, as one piece, a grip 14 and a longitudinal portion 16 defining a longitudinal housing 18, being open to the upper side thereof for housing for example a recoil spring 20, a central locking bolt 22 and a barrel 24.

A breechblock 26 is slidingly mounted on the frame 12, to the upper side of the longitudinal portion 16, for stopping the longitudinal housing 18.

In accordance with a possible embodiment, a bolt lock 28 is transversally inserted into the longitudinal portion 16 of the frame and defines a front stop of the breechblock 26 within the longitudinal housing 18.

According to a possible embodiment, a stop lever 30 of the breechblock is mounted on the longitudinal portion 16 of the frame, for example at the connection with the grip 14, in order to hold the breechblock in a back position subsequent to the shooting of the last cartridge.

In accordance with a possible embodiment, an extractor 32 is mounted on the breechblock in order to extract the cartridge case.

A firing pin, preferably divided into a front portion 34*a* and a rear portion 34*b* structurally separate from each other, has been indicated with 34.

According to a possible embodiment, a latch 36 of the firing pin 34 is housed in the breechblock 26, urged by a spring 38 to a locking position of the same firing pin. The latch 36 defines an automatic safety in order to avoid accidental shots in the case of impacts or falls of the gun.

In accordance with a possible embodiment, the gun comprises a manual safety 40 assembled in a cross housing of the breechblock 26 and adapted to be manually inserted and disconnected by the shooter. Advantageously, the manual safety 40 comprises a safety pin 42 protruding from the breechblock 26 with a head 44. By acting on the head 44, the safety pin 42 is caused to rotate between a resting position in which it is possible to shoot and a working position in which the shot is avoided. Optional embodiments of the manual safety 40 will be described herein below.

The frame 12 comprises a housing for a trigger 46 being rotary mounted on a pin 48 and affected by a spring 50.

A cross housing 52 extends along the grip 14 and opens both on the upper side thereof, in the longitudinal housing 18, and on the lower side thereof, at the bottom of the grip 14. The cross housing 52 is arranged along a rear portion of the grip 14 and is adapted to house, at least partially, the elements constituting a firing mechanism 54.

In accordance with a possible embodiment, the cross housing 52 is adapted to accommodate a plug 56 of the frame at the lower side thereof. A pin 58 is transversally inserted into the grip in order to lock the plug 56.

A further cross housing 60 extends along the grip 14 and opens both on the lower side of the grip and the upper side thereof, in the longitudinal housing 18. The further cross housing 60 is arranged along a front and central portion of the grip 14 and is adapted to house a weapon magazine. A partition wall 63 divides the cross housing 52 and the further cross housing 60 within the grip 14.

In accordance with a possible embodiment, the front portion of the grip 14 is adapted to house means 64 for locking and unlocking the magazine, particularly adapted to interfere with a magazine box in the further cross housing 60.

The firing mechanism 54 comprises, besides the trigger 46, a connecting lever 68 being connected to an arm 70 of the trigger and extending along the longitudinal housing 18, sideways the latter. In accordance with a possible embodiment, the connecting lever 68 is substantially L-shaped. A first arm 68*a* of the connecting lever 68 extends along the extending direction of the longitudinal housing 18 whereas a second arm 68*b* extends transversally to the first. Preferably, the second arm 68*b* is centrally provided with a notch 68*c*.

The firing mechanism 54 further comprises a hammer 72 rotary mounted around a hammer pin 74 and a trigger bar 76 rotary mounted around its respective trigger bar pin 78 and affected by a spring 80 against the hammer 72. In accordance with a possible embodiment, the hammer 72 comprises one or more teeth 82 adapted to be in contact with the trigger bar 76 in order to lock the hammer in its corresponding positions around its respective hammer pin 74.

In accordance with a possible embodiment, the connecting lever 68 is adapted to interact with the trigger bar 76 and with the hammer 72. For example, the connecting lever 68 comprises an extension 84 in a direction which is transversal to the same connecting lever and adapted to interact with the trigger bar 76 and with the hammer 72.

The hammer 72 is connected to a carrier spring 86, for example by means of at least one spring-carrier rod 88 hinged on the hammer 72, for example by means of a pin 90. The spring-carrier rod 88 is inserted along the carrier spring 86. The carrier spring 86 is adapted to be inserted into the cross housing 52 and react against the plug 56 of the frame.

As mentioned above, some embodiments of the manual safety will be described herein below.

In accordance with a possible embodiment, in the case where the firing pin 34 comprises two portions being front 34*a* and rear 34*b*, respectively, the safety pin 42 comprises a hole 92 adapted to accommodate the rear portion 34*b*. The two portions of the firing pin 34 are aligned in the resting position of the safety pin 42. The rotation of the safety pin 42 in the working position causes the misalignment between the front 34*a* and rear 34*b* portions of the firing pin thus making it ineffective.

In accordance with a possible embodiment, the safety pin 42 of the manual safety 40 may advantageously comprise a cam surface 100 adapted to allow an upper end 98 of the connecting lever 68 to be moved away from the trigger bar 76 and the hammer 72, in contrast to a spring 102. In the resting position of the safety pin 42, the connecting lever 68 is arranged so as to interact with the trigger bar 76 and the hammer 72.

According to a further possible embodiment of the manual safety, a hammer-releasing lever adapted to rotate around a pin 106 has been indicated with 104.

The hammer-releasing lever 104 is provided with two arms 104*a*, 104*b* being angled to each other. A first arm 104*a* is in contact with the safety pin 42 of the manual safety 40 whereas the second arm 104*b* can move along a trajectory in which it interferes with the trigger bar 76. The safety pin 42 of the manual safety 40 comprises a cam portion 108 which causes the hammer-releasing lever 104 to rotate by causing the safety pin 42 to rotate from the resting position to the working position, so as to move away the trigger bar 76 from the hammer 72. A spring 110 affects the hammer-releasing lever 104 away from the trigger bar 76.

Advantageously, the manual safety 40 can be shaped so as to carry out one or more of the functions described above.

In accordance with a possible embodiment, the firing mechanism 54 comprises a latch-releasing lever 112 adapted to act on the latch 36 of the firing pin 34, if provided. According to a possible embodiment, the latch-releasing lever 112 comprises two arms 112*a*, 112*b* being angled to each other. A first arm 112*a* is adapted to interact with the latch 36 whereas a second arm 112*b*, particularly a bent end 112*c*, is arranged along the trajectory of the connecting lever 68.

The latch-releasing lever 112 is rotary mounted on a pin 106, preferably on the same pin 106 on which the hammer-releasing lever 104 is mounted, if provided. A spring 110 affects the latch-releasing lever 112 in the resting position, in which the firing pin 34 is locked by the latch 36. Advantageously, the same spring 110 affects both the hammer-releasing lever 104 and the latch-releasing lever 110. Preferably, the spring 110 is inserted onto the pin 106 in order to hold the two levers on a side of the same pin.

Advantageously, the gun 10 comprises two hangers 114, facing each other and adapted to provide a framework for at least one portion of the firing mechanism 54. Particularly, the two hangers 114 define a framework for the whole firing mechanism 54 except for the trigger 46 and the connecting lever 68.

The two hangers 114 are opposed to and face each other, at a relative distance leaving the space for housing the firing mechanism components between the same two hangers.

The two hangers 114 are adapted to be inserted into the cross housing 52 after the firing mechanism has been assembled on the same hangers. In the gun assembled position, the two hangers 114 are arranged along the sides of the cross housing 52.

According to a possible embodiment, the two hangers are manufactured by shaped plates.

The two hangers 114 will be described herein below with particular reference to FIGS. 2-5.

Advantageously, the relative distance between the upper portions of the two hangers is higher than the relative distance between the central and lower portions of the same hangers. For example, one of the two hangers has a bending line 115 between an upper portion and a central portion of the same hanger.

In accordance with a possible embodiment, the two hangers are connected to each other by means of a bridge 116 which transversally extends between the two hangers. Advantageously, the bridge 116 is arranged so as to define a stop for the hammer 72.

Figure 6:
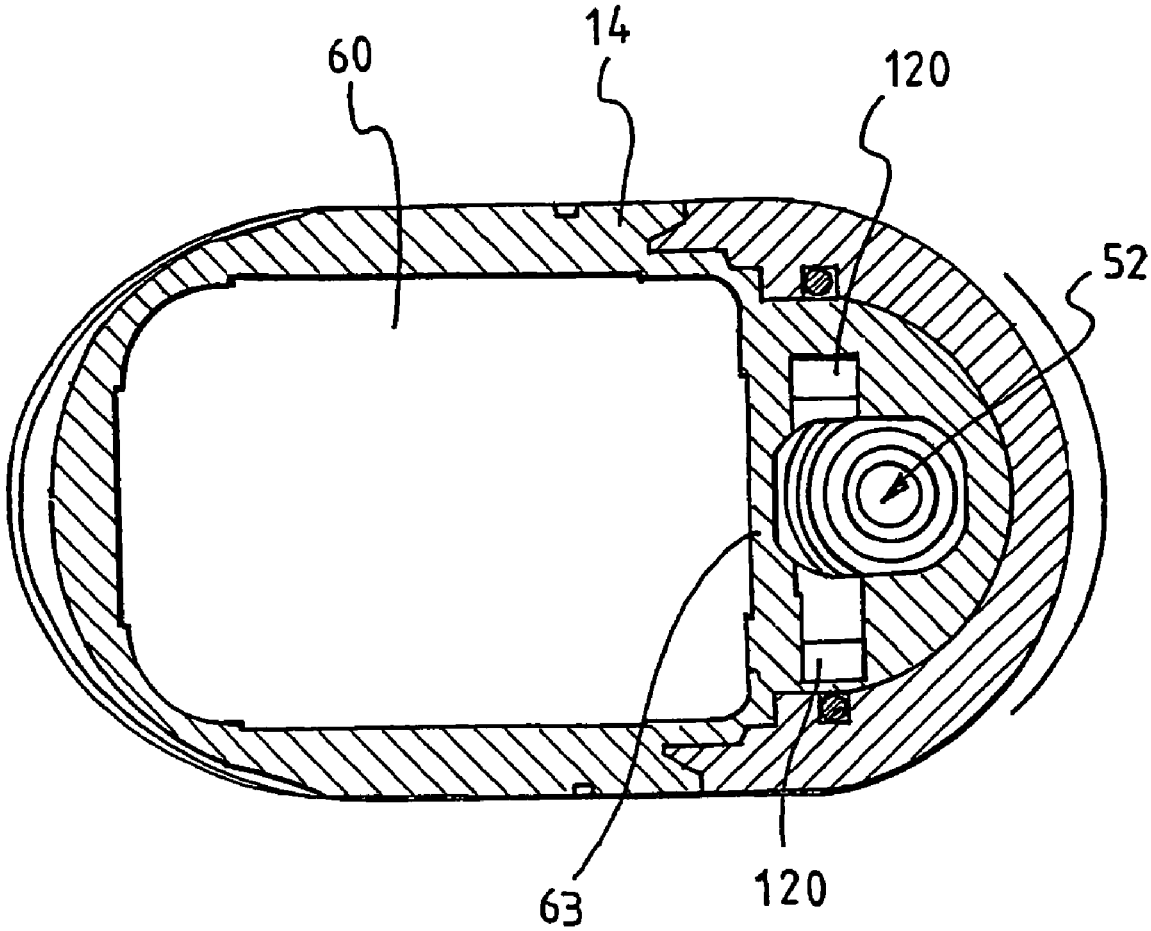
FIG. 6 shows a cross-sectional view of the grip of the frame illustrated in FIG. 1.

Advantageously, each hanger 114 is provided with an upper portion having a greater width than the width of a respective lower portion. Particularly, each hanger comprises a respective leg 118 extending along the extending direction of the cross housing 52. In accordance with a possible embodiment, the gun frame comprises two cavities 120 (FIG. 6) each of which is adapted to accommodate a lower portion of a leg 118. Advantageously, the cavity 120 is counter-shaped relative to its respective leg, particularly the cavity 120 and the lower portion of its respective leg are provided with either a square or rectangular cross section.

According to a possible embodiment, one of the two hangers comprises an upper portion 122 having the shape of an ejector, thus made as one piece with its respective hanger.

Figures 2, 2A:
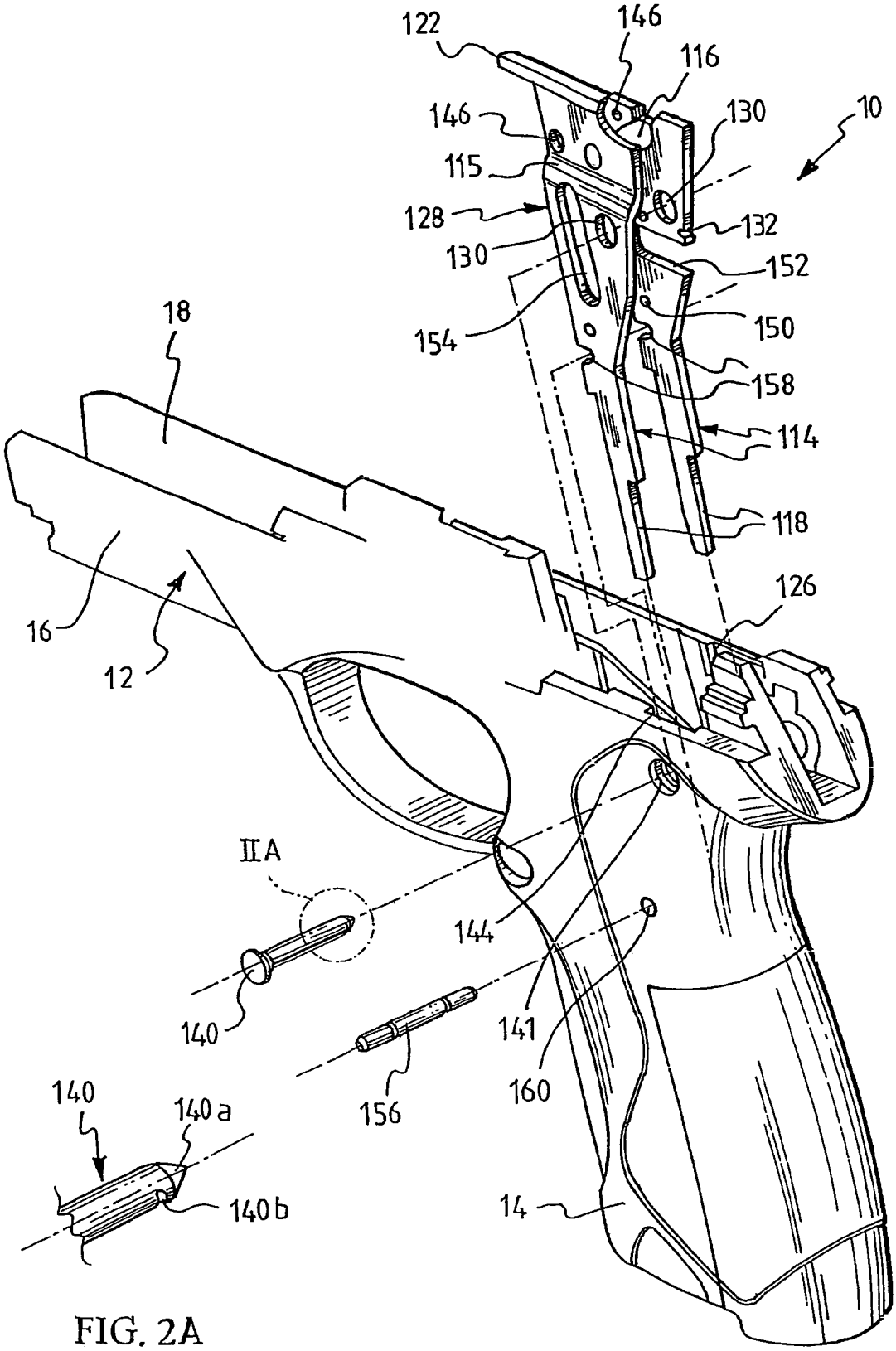
FIG. 2 shows a exploded perspective view of a frame for a gun and a framework according to the present invention.
FIG. 2A shows the enlarged detail IIA from FIG. 2.
Figure 3:
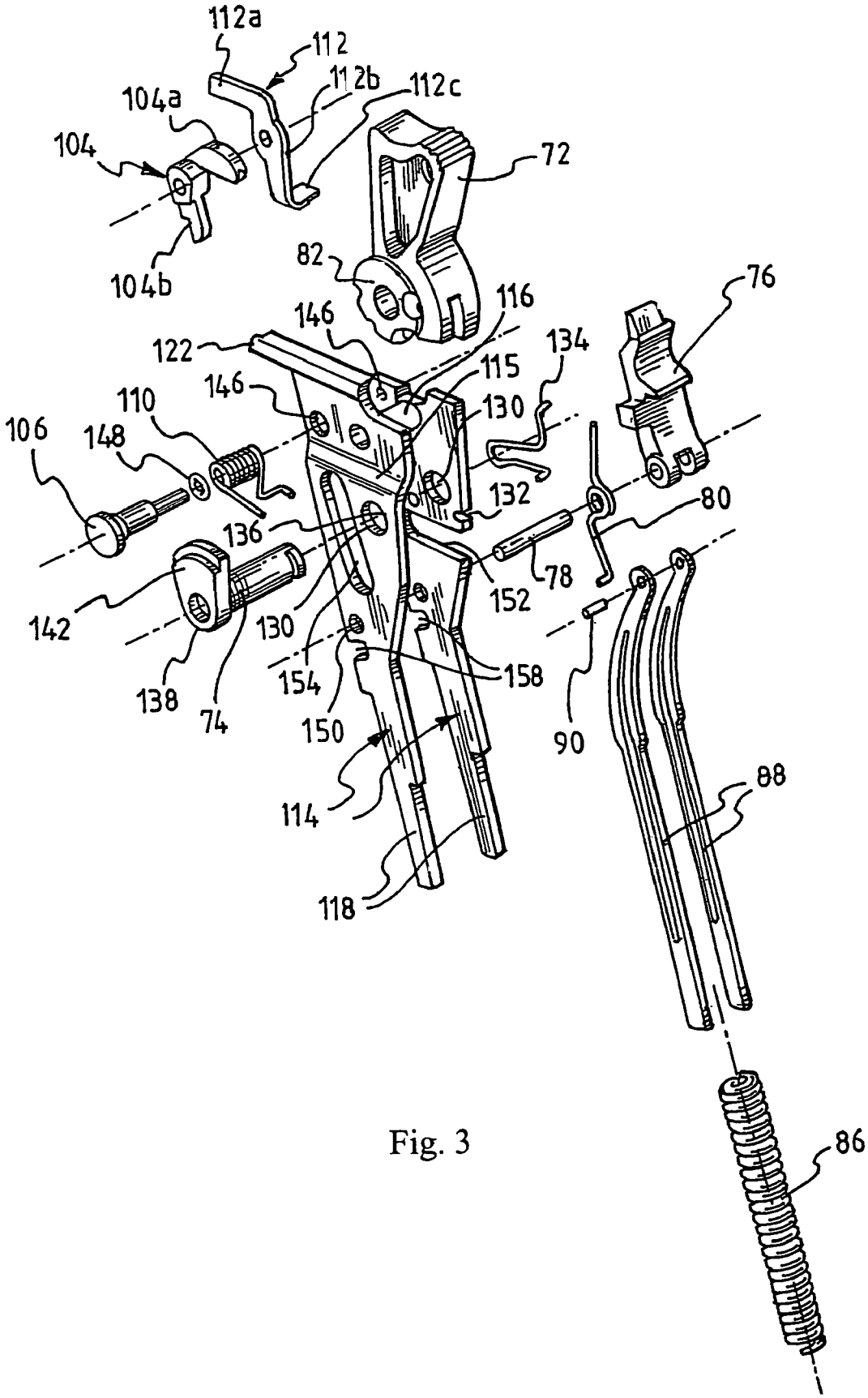
FIG. 3 shows a cut-away perspective view of a framework and a firing mechanism for a gun according to the present invention.

In accordance with a possible embodiment, at least one of the two hangers 114 comprises a side tooth 124 (FIG. 5) adapted to be inserted into a groove 126 which is open on the upper side of the longitudinal portion 16, inside the longitudinal housing 18, in order to lock possible onward movements of the hangers 114 (FIGS. 1 and 2). In accordance with a possible embodiment, the side tooth 124 is made as one piece in its respective hanger 114, for example by bending the plate defining the hanger. In the case where a single side tooth 124 is provided, the latter is provided in the hanger which does not comprise the ejector.

A flared portion of the hangers 114 adapted to support the firing mechanism 54, particularly the rotation pins of some firing mechanism components, has been indicated with 128.

In accordance with a possible embodiment, respective holes in each of the two hangers in order to accommodate the hammer pin 74, transversally to the two hangers, have been indicated with 130. Advantageously, a hanger may have a notch 132 in order to lock an end of a locking element 134 adapted to be inserted into a through slot 136 of the hammer pin 74. A striking pin 137 (FIG. 5) for the locking element 134 can be externally inserted onto one of the hangers.

Preferably, the holes 130 housing the hammer pin 74 are located at the lower side of the bridge 116, if provided, such that the bridge defines a stop for the hammer 72.

In accordance with a possible embodiment, the hammer pin 74 is a tubular element provided with a housing 138 being coaxial to the pin in order to accommodate a locking pin 140 passing through the frame 12 and locking the hangers 114 on the frame (FIG. 1). The pass-through opening of the pin 140 in the frame 12 has been indicated with 141 (FIG. 2). In accordance with a possible embodiment, the locking pin is provided with a cone-shaped end 140*a* in which a notch 140*b* is provided (FIG. 2A), adapted to accommodate the locking element 134 (FIG. 5).

According to a possible embodiment, the hammer pin 74 is provided with a flared end 142 in order to provide an abutment against its respective hanger 114. Advantageously, the flared end 142 is adapted to be housed in a notch 144 in the frame 12 from which it protrudes from the upper side thereof. In other words, the flared end 142 also defines a safety strike in order to stop the backward movement of the breechblock 26 in the case of breaking of the same breechblock.

In accordance with a possible embodiment, the two hangers 114 comprise respective holes 146 in order to house elements of either automatic or manual safety devices of the gun. Advantageously, the hangers 114 are adapted to house the hammer-releasing lever 104 and/or the latch-releasing lever 112. Particularly, the holes 146 are adapted to house the pin 106, transversally to the two hangers 114, on which the hammer-releasing lever 104 and/or the latch-releasing lever 112 is mounted. The holes 146 are obtained in a front and upper position relative to the holes 130 housing the hammer pin 74. Preferably, the holes 146 are provided in a front portion of the bridge 116.

Figure 5:
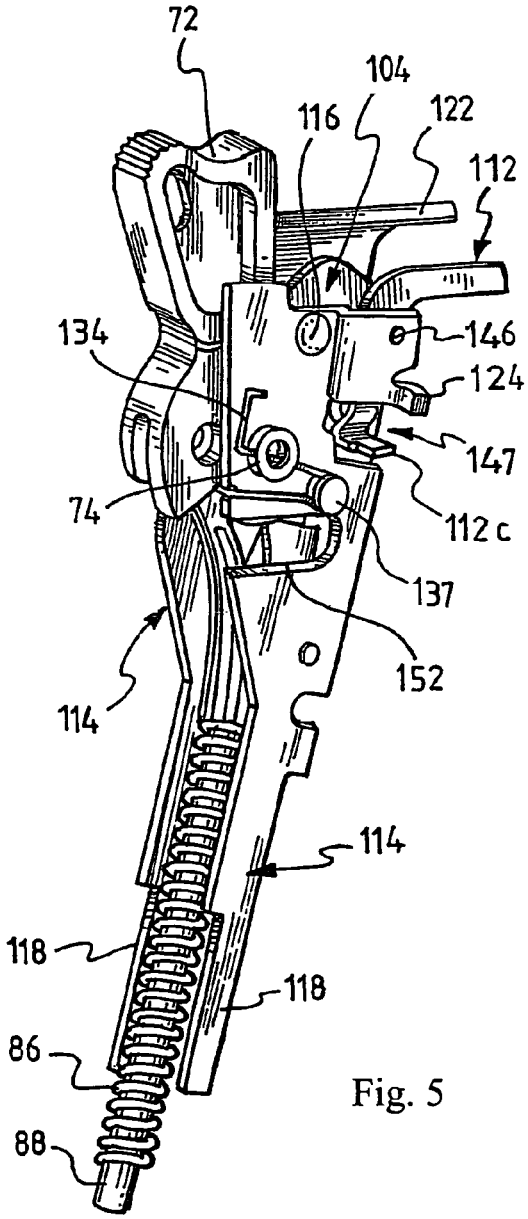
FIG. 5 shows the firing mechanism from FIG. 4 according to a different angle.

In accordance with a possible embodiment, the latch-releasing lever 112 comprises the angled end 112*c* which laterally protrudes through its respective hanger by means of a notch 147 being open to the front side of the same hanger (FIG. 5).

A stop ring of the pin 106 on the hangers 114 has been indicated with 148.

According to a possible embodiment, the hangers 114 comprise holes 150 in order to accommodate the trigger bar 76, and particularly in order to accommodate the pin 78 of the trigger bar 76. The holes 150 are located at the lower and front sides of the holes 130 housing the hammer pin 74.

In accordance with a possible embodiment, an aperture obtained in at least one of the hangers 114 from a rear portion of the same hanger has been indicated with 152. Advantageously, the aperture 152 extends according to a direction which is parallel to the longitudinal housing 18 in order to allow the connecting lever 68, particularly the extension 84 thereof, to interact with the trigger bar 76 and the hammer 72.

According to a possible embodiment, a lightening aperture of at least one of the hangers has been indicated with 154.

In accordance with a possible embodiment, a further pin adapted to be inserted through the frame 12, particularly through the grip 14, in order to lock the hangers 114 has been indicated with 156 (FIG. 1). Advantageously, the hangers comprise housings 158 in order to accommodate the further pin 156. Preferably, the housings 158 are open to the front portion of the hangers 114.

Figure 4:
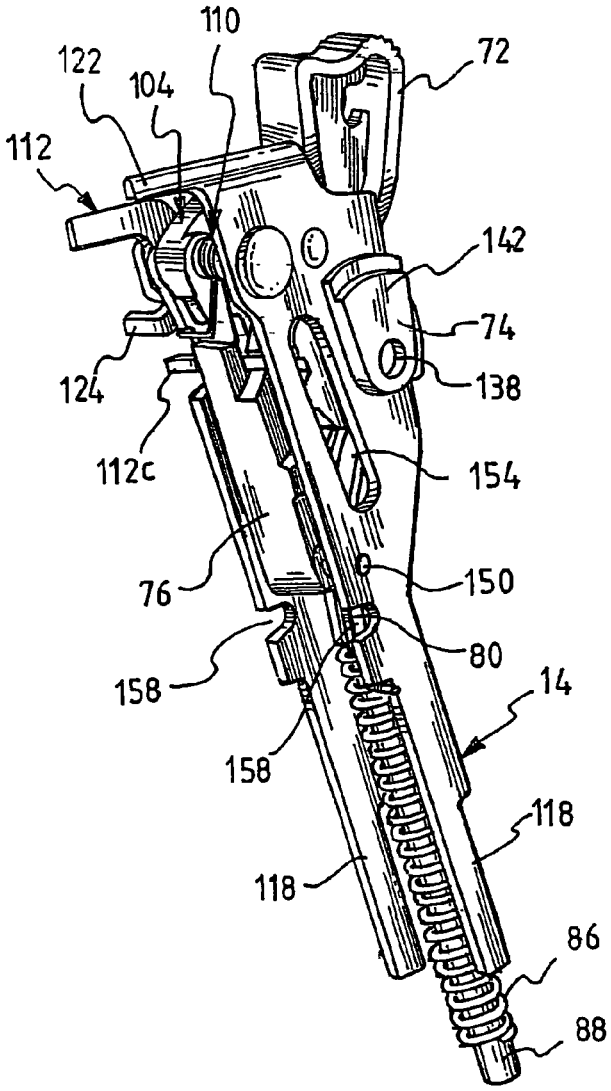
FIG. 4 shows a perspective view of the firing mechanism from FIG. 3 assembled.

The pass-through opening of the further pin 156 in the frame 12 has been indicated with 160. In an assembled configuration, the pin 156 is locked by a portion of the spring 80 of the trigger bar 76 (FIG. 4 shows the position of the spring 80 for stopping a housing 158, the pin 156 is not shown).

The method for assembling the firing mechanism of a gun with reference to the embodiments described above will be described herein below.

The assembling of the further gun components is not expressly described because it is substantially conventional.

In accordance with the present invention, the assembling of the firing mechanism provides that at least some firing mechanism components are mounted on a framework structurally independent from the frame 12 of the gun and then the framework is inserted into the gun frame, for example in the cross cavity 54. Finally, the framework is locked on the frame, for example by means of at least one pin which transversally passes through both the frame and the same framework.

Advantageously, except for the trigger 46 and the connecting lever 68, all the other components of the firing mechanism 54 are mounted on the framework. After the assembling of the firing mechanism has been carried out on its respective framework, an independent structure adapted to be inserted from the top of the cross cavity 52 of the frame 12 is obtained.

In accordance with a possible embodiment, the framework comprises the two hangers 114 being connected to each other and located at a certain distance by means of the bridge 116.

Particularly, the firing mechanism 54 is assembled between the two hangers 114, being arranged so as to define their respective support shoulders of support pins of the firing mechanism components.

In accordance with a possible embodiment, the framework for example consisting of the two hangers 114 holds at least the hammer 72 on its respective hammer pin 74. Therefore, the assembling provides that the hammer pin 74 is inserted onto the framework and through the hammer 72. The spring-carrier rod 88 into which the carrier spring 86 is inserted is pivoted on the hammer 72.

In accordance with a possible embodiment, the framework for example consisting of the two hangers 114 holds at least the trigger bar 76 on its respective pin 78. Therefore, the assembling provides that the trigger bar pin 78 is inserted onto the framework and through the trigger bar 76. Simultaneously, the spring 80 of the trigger bar 76 is assembled.

Advantageously, the framework for example consisting of the two hangers 114 holds both the hammer 72 on its respective hammer pin 74 and the trigger bar 76 on its respective pin 78. Consequently, the assembling step provides that the respective pins are inserted onto and locked on the framework.

In the case where manual and/or automatic safety devices are provided, the framework can also hold some components of these devices. For instance, the framework for example consisting of the two hangers 114 holds the hammer-releasing lever 104 and/or the latch-releasing lever 112. In the case where both are provided, the only pin 106 is inserted into the framework, through the two levers and through its respective spring 110.

Advantageously, the framework for example consisting of the two hangers 114 houses both the hammer, and the trigger bar and the hammer- and latch-release levers thereby defining a structure independent from the gun frame.

The assembled framework is thus inserted into the gun frame, preferably from the top of and within the cross housing 52. Particularly, the legs 118 are inserted into the respective cavities 120 of the frame. Moreover, the side tooth 124, if provided, is inserted into the groove 126 of the frame.

In accordance with a possible embodiment, the flared end 142 of the hammer pin 74 is inserted into the notch 144 of the frame 12.

By inserting the framework into the frame, the spring-carrier rod 88 and the carrier spring 86 are inserted along the cross cavity 52. The plug 56 being inserted into the lower side of the cross cavity 52 and locked by its respective pin 58 defines a striking element for carrier spring 86.

The connecting lever 68 is longitudinally arranged along the longitudinal housing 18, such that the cross extension 84 thereof is inserted into the aperture 152 of one of the hangers in order to be brought in contact with the trigger bar 76 and the hammer 72.

Finally, the framework for example consisting of the two hangers 114 is locked in the frame 12 for example by transversally inserting at least one pin 140. Preferably, the pin 140 is inserted into the opening 141 of the frame and through the hammer pin 74. Advantageously, the cone-shaped end 140*a* of the pin 140 thrusts the locking element 134 such that the pin is completely inserted into the housing 138. Then, a portion of the locking element is released within the notch 140*b* thus locking the pin 140. In order to free the pin 140 and allow the weapon to be disassembled, the locking element 134 requires to be thrust downwards thus being caused to drop from the notch 140*b*.

Optionally, a further pin 156 being transversally inserted between the frame and the framework can be provided. For example, the further pin 156 is inserted into the opening 160 of the frame and passes through the framework in the housings 158, for example being open on the front side thereof. Advantageously, the spring 80 of the trigger bar 76 locks at least one of the housings 158 at the front side thereof and axially locks the pin 156.

In order to disassemble the gun and particularly the firing mechanism, the pin 140 and optionally the further pin 156 are extracted from the gun frame, the framework for example consisting of the two hangers is extracted and the firing mechanism components are disassembled from the framework outside the frame.

The assembled gun operation mode will be described herein below with reference to the embodiments described above, particularly with reference to a gun comprising all the safety devices described above, such as illustrated in the annexed figures.

In the case where the manual safety 40 is in the resting position, the two portions constituting the firing pin 34 are aligned with each other, the hammer-releasing lever 104 is in the resting position, thereby the hammer 72 is for example cocked and hold by the trigger bar 76 against the thrust exerted by the carrier spring 86 and the cam surface 100 does not interfere with the connecting lever 68. Particularly, the second arm 68*b* and the cross extension 84 of the connecting lever 68 are arranged so as to interact with the latch-releasing lever 112 and with the trigger bar 76/hammer 72, respectively, following the movement transmitted by the trigger 46 to the same connecting lever.

In fact, when the movement of the trigger 46 is transmitted to the connecting lever 68, the latter passes through the framework along the aperture 152 by means of the cross extension 84 thereof and interacts on the trigger bar 76 and the hammer 72 thus allowing the rotation thereof following the thrust exerted by the carrier spring 86. The second arm 68*b*, in the last movement length of the trigger 46, interacts with the bent end 112*c* of the latch-releasing lever 112, through the notch 147. The latch-releasing lever 112 rotates against the thrust of its respective spring 110 and lifts the latch 36 thus making the firing pin 34 free.

During the breechblock back movement, the upper portion 122 of one of the hangers 114 advantageously acts as an ejector for the cartridge case.

The rotation of the manual safety 40 prevents the shooting by preferably acting on several aspects. First of all, the rear portion 34*b* of the firing pin is misaligned relative to the front portion 34*a*. Furthermore, the hammer-releasing lever 104 is rotated by the cam portion 108 until the trigger bar 76 of the hammer 72 is moved away, thus uncocking the hammer. Finally, the cam surface 100 interacts with the connecting lever 68 so as to lower the latter against the thrust of its respective spring 102. In this position the extension 84 is misaligned relative to the trigger bar 76 and the hammer 72. Moreover, the notch 68*c* of the connecting lever 68 is aligned with the bent end, 112*c* of the latch-releasing lever 112.

From what has been stated above, it should be appreciated that the fact of providing a gun according to the present invention allows to meet the above-said need for facilitating the assembling step of the firing mechanism in the frame of the gun, thus reducing the assembling and disassembling times of the latter.

This advantage is achieved by providing a framework on which at least some firing mechanism components are mounted outside the frame and means for locking the framework inside the same frame, after it has been inserted into a cavity adapted to house it. Particularly, the means for locking provide both a shape coupling between the framework and the frame and means transversally inserted between the frame and the framework thus obtaining not only a proper and reliable insertion of the framework into the frame but also a new and more homogeneous distribution of the force lines that are released on the frame through the firing mechanism components.

Advantageously, the framework is provided by means of two hangers mutually facing each other at a distance adapted to accommodate the firing mechanism components. Preferably, this distance is defined by a connecting bridge between the two hangers which has the further function of stopping the hammer, as a function of its position on the framework. The presence of legs aids in stabilizing the structure, given that they extend in height for more than a half of the grip and are inserted for a lower length into suitable notches of the frame.

The locking of the hangers in the frame is facilitated by providing a shape coupling between portions of the hangers and housings of the frame, thus simultaneously allowing an excellent positioning accuracy. For example, the coupling between the legs 118 and their respective-cavities 120 allows the framework to be properly positioned both with reference to the height and to the longitudinal position of the latter. Moreover, this coupling provides a first constraint adapted to react to the forces generated during the shooting.

Furthermore, the advantageous provision of a side tooth 124 allows the movements of the framework to be limited, particularly towards the front portion of the frame, thus stabilizing it.

The provision of a cross locking between the frame and the framework, for example ensured by the pin 140, contributes to ensure the framework position and the proper transmission of the forces involved between the framework and the frame. Advantageously, this locking is provided coaxially to the hammer pin 74 (pin 140) which can thus release its own stresses even directly on the frame whereas the remaining firing mechanism components are mainly held on their respective hangers thus considerably making the structure and the assembly easier.

The optional provision of a further pin 156 may aid in further stabilizing the structure.

The two hangers define two holding sidewalls of the firing mechanism, yet allowing the interaction with the components being directly mounted on the gun frame. Furthermore, the same hangers can integrate further gun components, such as the ejector, thus reducing the number of components and thereby facilitating their respective positioning.

It is understood that variants and/or additions to what has been described and shown above can be provided.

The annexed figures show a gun comprising several manual/automatic safety devices. Optionally, only some of the functions described and shown can be provided.

Particularly, all the possible embodiments described can be provided independently from one another.

Alternatively to what is shown in the annexed figures, the framework can be differently manufactured, by replacing for example the hangers with other components or providing hangers having shape, numbers and sizes which are different from the ones described and shown. For example, an ejector of the conventional type can be provided, which is directly mounted either on the frame or to one of the hangers 114.

According to a possible variant embodiment, the framework also holds only one of the firing mechanism components, thus facilitating in the same way the positioning and assembling of the latter within the frame, besides defining a new distribution of the force lines on the frame.

The further pin 156 can be omitted. Optionally, the pin 140 can be differently positioned.

To the preferred embodiment of the gun described above, those skilled in the art, aiming at satisfying contingent and specific needs, will be able to carry out several modifications, adjustments and replacements of elements with other elements being functionally equivalent thereto, without thereby departing from the scope of the following claims.

What is claimed is:

1. A gun comprising a frame having a grip and a longitudinal portion defining a longitudinal housing, a framework on which at least some components of a firing mechanism are mounted, said framework being inserted into a cross cavity of the frame, and means for locking the framework inside the frame, wherein said framework comprises two hangers adapted to extend along the sides of said cross cavity into said cross cavity in order to guide said framework into said cavity and wherein said cross cavity extends along said grip and opens both on the upper side thereof, in said longitudinal portion, and on the lower side thereof at the bottom of said grip.

2. The gun according to claim 1, wherein said framework is a structure separable from the frame of the gun.

3. The gun according to claim 1, wherein said framework holds the firing mechanism except for a trigger and a connecting lever extending from the trigger.

4. The gun according to claim 1, wherein said components of the firing mechanism are assembled between the two hangers.

5. The gun according to claim 4, wherein said framework comprises a bridge connecting the two hangers.

6. The gun according to claim 5, wherein said bridge is located between the two hangers in a position in which said bridge defines a stop for a hammer of the firing mechanism.

7. The gun according to claim 1, wherein the hangers are manufactured from shaped plates.

8. The gun according to claim 1, wherein a relative distance between upper portions of the two hangers is greater than a relative distance between central and lower portions of the two hangers.

9. The gun according to claim 1, wherein at least one of the two hangers has a bending line between an upper portion and a central portion of the at least one of the two hangers.

10. The gun according to claim 1, wherein at least one hanger comprises a leg extending along the longitudinal housing.

11. The gun according to claim 10, wherein the frame comprises at least one cavity configured to accommodate a lower portion of a leg.

12. The gun according to claim 11, wherein the cavity is counter-shaped relative to its respective leg.

13. The gun according to claim 1, wherein at least one of said hangers comprises an upper portion having the shape of an ejector, said upper portion made as one piece with the at least one of said hangers.

14. The gun according to claims 13, wherein a side tooth is provided in the hanger which does not comprise the ejector, said side tooth configured to be inserted into a groove of the frame.

15. The gun according to claim 1, wherein at least one of the two hangers comprises a side tooth configured to be inserted into a groove of the frame.

16. The gun according to claim 15, wherein the side tooth and the at least one of the two hangers are provided as one piece.

17. The gun according to claim 1, wherein said hangers comprise a flared portion adapted to hold the components of the firing mechanism.

18. The gun according to claim 1, wherein each of the two hangers comprise a hole to accommodate a hammer pin, said hammer pin extending between the two hangers.

19. The gun according to claim 18, wherein at least one of the two hangers is provided with a notch in order to lock an end of a locking element configured to be inserted into a through slot of the hammer pin.

20. The gun according to claim 19, wherein a striking pin of the locking element is externally inserted onto one of the two hangers.

21. The gun according to claim 18, wherein each of the holes accommodating the hammer pin are located below a bridge which transversally connects the two hangers.

22. The gun according to claim 1, wherein the two hangers each comprise holes to house elements of automatic or manual safety devices of the gun.

23. The gun according to claim 22, wherein the two hangers are configured to house a hammer-releasing lever of the firing mechanism.

24. The gun according to claims 23, wherein the holes are adapted to house a pin, transversally to the two hangers, on which at least one of the hammer-releasing lever and a latch-releasing lever is mounted.

25. The gun according to claim 22, wherein the two hangers are configured to house a latch-releasing lever of the firing mechanism.

26. The gun according to claim 25, wherein each latch-releasing lever comprises an angled end laterally protruding through a notch on the front side of its respective hanger.

27. The gun according to claim 22, wherein each of the holes to house elements of automatic or manual safety devices are located in a front and upper position relative to a hole in each of said hangars to accommodate housing a hammer pin.

28. The gun according to claim 22, wherein the holes to house elements of automatic or manual safety devices are located forward on each of said hangars relative to a bridge for connecting the two hangers to each other.

29. The gun according to claim 1, wherein the hangers comprise holes to accommodate a pin of a trigger bar.

30. The gun according to claim 29, wherein the holes to accommodate the pin of the trigger bar are located on each hangar below and forward of holes housing a hammer pin.

31. The gun according to claim 1, wherein at least one hanger is provided with an aperture in a rear portion of the at least one hanger to allow a connecting lever of the firing mechanism to interact with one of a trigger bar or a hammer.

32. The gun according to claim 1, wherein at least one hanger comprises a lightening aperture.

33. The gun according to claim 1, wherein the means for locking the framework in the frame comprise at least one locking pin being transversally inserted between the frame and the framework.

34. The gun according to claim 33, wherein said framework accommodates a hammer pin provided by a tubular element having a housing coaxial to the pin in order to accommodate said locking pin.

35. The gun according to claim 33, wherein said pin comprises a notch adapted to accommodate a locking element on the hangers.

36. The gun according to claim 35, wherein said pin comprises a cone-shaped end configured to move said locking element and cause the latter to trigger within said notch.

37. The gun according to claim 33, wherein the means for locking the framework in the frame comprises a further pin configured to be inserted through the frame and one or more housings of the framework.

38. The gun according to claim 37, wherein the one or more housings are open to the framework front portion.

39. The gun according to claim 38, wherein said further pin is locked on the framework by a portion of a spring of a trigger bar of the firing mechanism.

40. The gun according to claim 1, wherein said framework is configured to hold a hammer pin having a flared end, said flared end configured to abut against the framework.

41. The gun according to claim 40, wherein the flared end of the hammer pin is housed in a notch in said frame, said flared end protruding from the upper side of the notch so as to define a safety strike for stopping the backward movement of a breechblock in the case of breaking of the breechblock.

42. The gun according to claim 1, wherein said means for locking the framework within the frame comprise at least one shape coupling between the framework and the frame.

43. The gun according to claim 1, wherein said means for locking the framework within the frame comprise at least one locking element being transversally inserted between the framework and the frame.

44. A method for assembling a gun comprising the steps of:

presetting a frame of said gun, said frame having a grip and a longitudinal portion defininig a longitudinal housing, mounting at least some components of a firing mechanism on a framework comprising two hangers adapted to extend into a cross cavity of the frame along the side of said cross cavity, said cross cavity extending along said grip and opening both on the upper side thereof, in said longitudinal portion, and on the lower side thereof, at the bottom of said grip, inserting said framework into a cross cavity of the frame, and locking the framework within the frame.

45. The method for assembling a gun according to claim 44, wherein said framework is a structure separable from the frame of the gun.

46. The method for assembling a gun according to claim 44, wherein the firing mechanism except for a trigger and a connecting lever extending from the trigger is mounted on said framework.

* * * * *

UNITED STATES PATENT AND TRADEMARK OFFICE

CERTIFICATE OF CORRECTION

PATENT NO. : 7,347,022 B2
APPLICATION NO. : 11/260378
DATED : March 25, 2008
INVENTOR(S) : Ugo Gussalli Beretta It is certified that error appears in the above-identified patent and that said Letters Patent is hereby corrected as shown below:

Title page, item [73]
Change the assignee's name to read as follows:

FABBRICA D'ARMI PIETRO BERETTA S.P.A.

Signed and Sealed this

Seventh Day of October, 2008

JON W. DUDAS
*Director of the United States Patent and Trademark Office*